US011655827B2

(12) United States Patent
Kato et al.

(10) Patent No.: US 11,655,827 B2
(45) Date of Patent: May 23, 2023

(54) PUMP DEVICE

(71) Applicant: AISAN KOGYO KABUSHIKI KAISHA, Obu (JP)

(72) Inventors: Nobuhiro Kato, Tokai (JP); Takashige Inagaki, Obu (JP); Keiji Nakaya, Nisshin (JP); Hidemasa Torii, Anjo (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 17/273,254

(22) PCT Filed: Sep. 17, 2019

(86) PCT No.: PCT/JP2019/036338
§ 371 (c)(1),
(2) Date: Mar. 3, 2021

(87) PCT Pub. No.: WO2020/066745
PCT Pub. Date: Apr. 2, 2020

(65) Prior Publication Data

US 2021/0324875 A1 Oct. 21, 2021

(30) Foreign Application Priority Data

Sep. 25, 2018 (JP) ..... JP2018-178686

(51) Int. Cl.
*F04D 29/42* (2006.01)
*F04D 17/08* (2006.01)
(Continued)

(52) U.S. Cl.
CPC ..... *F04D 29/4206* (2013.01); *F04D 17/08* (2013.01); *F04D 25/06* (2013.01); *F04D 29/053* (2013.01); *F04D 29/056* (2013.01)

(58) Field of Classification Search
CPC ..... F04D 17/08; F04D 25/06; F04D 29/053; F04D 29/056; F04D 29/4206; F04D 29/70; F04D 29/706
See application file for complete search history.

(56) References Cited

U.S. PATENT DOCUMENTS 2,684,034 A * 7/1954 Roth ..... F04D 29/043 415/55.1
6,102,672 A * 8/2000 Woollenweber ..... F04D 25/06 417/370

(Continued)

FOREIGN PATENT DOCUMENTS

JP S4922566 Y1 6/1974
JP S5081403 U 7/1975

(Continued)

OTHER PUBLICATIONS

PCT/JP2019/036338 International Preliminary Report on Patentability dated Apr. 8, 2021 (9 p.).

(Continued)

*Primary Examiner* — Courtney D Heinle
*Assistant Examiner* — Andrew Thanh Bui
(74) *Attorney, Agent, or Firm* — Conley Rose, P.C.

(57) ABSTRACT

A centrifugal pump includes a motor portion including a rotor rotatably disposed in a rotor chamber and includes a pump portion including an impeller rotatably disposed in a pump chamber. The impeller is coupled to the rotor. The centrifugal pump also includes a casing that separates the rotor chamber from the pump chamber, and a bearing that rotatably supports a rotor shaft of the rotor and to which grease is supplied is provided. Two communication holes extend through the casing and provide fluid communication between the rotor chamber and the pump chamber.

9 Claims, 8 Drawing Sheets

(51) Int. Cl.

| | |
|---|---|
| ***F04D 25/06*** | (2006.01) |
| ***F04D 29/053*** | (2006.01) |
| ***F04D 29/056*** | (2006.01) |

(56) References Cited

U.S. PATENT DOCUMENTS

| | | | | |
|---|---|---|---|---|
| 7,347,674 | B2 * | 3/2008 | Terry | F04D 29/2222 417/423.1 |
| 9,863,430 | B2 * | 1/2018 | Lee | F04D 29/4206 |
| 10,473,110 | B2 * | 11/2019 | Iizuka | F04D 29/4206 |
| 2018/0003081 | A1 * | 1/2018 | Isayama | F16C 35/02 |
| 2018/0347511 | A1 * | 12/2018 | Makino | F04D 25/00 |

FOREIGN PATENT DOCUMENTS

| | | | |
|---|---|---|---|
| JP | S52157505 | U | 11/1977 |
| JP | S559839 | U | 1/1980 |
| JP | 2002058194 | A | 2/2002 |
| JP | 2012017712 | A | 1/2012 |

OTHER PUBLICATIONS

Japanese Office Action dated Jan. 18, 2022, for Japanese Application No. 2018-178686 (2 p.).
English Translation of Japanese Office Action dated Jan. 18, 2022, for Japanese Application No. 2018-178686 (2 p.).
PCT/JP2019/036338 International Search Report and Written Opinion dated Dec. 3, 2019 (9 p.).
Japanese Office Action dated Jul. 14, 2021, for Japanese Application No. 2018-178686 (3 p.).
English Translation of Japanese Office Action dated Jul. 14, 2021, for Japanese Application No. 2018-178686 (4 p.).
Japanese Office Action dated Jan. 25, 2023, for Japanese Application No. 2018-178686 (2 p.).
English Translation of Japanese Office Action dated Jan. 25, 2023, for Japanese Application No. 2018-178686 (2 p.).

* cited by examiner

PUMP DEVICE

CROSS-REFERENCE TO RELATED APPLICATIONS

This application is a 35 U.S.C. § 371 U.S. National Stage Entry application claiming priority to PCT Patent Application No. PCT/JP2019/036338 filed Sep. 17, 2019, which claims priority to Japanese Patent Application No. 2018-178686 filed Sep. 25, 2018, each of which is hereby incorporated herein by reference in its entirety for all purposes.

STATEMENT REGARDING FEDERALLY SPONSORED RESEARCH OR DEVELOPMENT

Not applicable.

BACKGROUND

The present disclosure relates generally to pump devices, and more particularly, to pump devices for pumping gas.

Japanese Unexamined Patent Publication No. 2012-17712 discloses a conventional pump device for pumping gas. The pump device comprises a motor portion with a rotor rotatably disposed in a rotor chamber. The pump device also includes a pump portion with an impeller rotatably disposed in a pump chamber and coupled to the rotor.

BRIEF SUMMARY

An object to be solved by the present disclosure is to provide a pump device configured to suppress grease loss from the bearing with a simple and inexpensive configuration.

Another object to be solved by the present disclosure is to provide a pump device configured to improve the drainage property of the pump chamber, thereby reducing the likelihood of impeller malfunction due to freezing.

The above-mentioned objects can be achieved by embodiments described herein.

A first embodiment of the present disclosure is a pump device for pumping a gas. The pump device comprises a motor portion including a rotor rotatably disposed in a rotor chamber and a pump portion including an impeller rotatably disposed in a pump chamber and coupled to the rotor. A bearing rotatably supports a rotor shaft of the rotor and is injected with a grease. The bearing is provided in a partition wall separating the rotor chamber from the pump chamber. At least two breathing passages that interconnect the rotor chamber and the pump chamber are formed in the partition wall.

According to the first embodiment, a circulation flow passage flows from the pump chamber to the rotor chamber and back to the pump chamber, and is formed by at least two breathing passages provided in the partition wall separating the rotor chamber from the pump chamber. Since gas flows preferentially through the circulation flow passage that bypasses the bearing, grease loss from the bearing may be suppressed. Also, unlike the pump device according to Japanese Unexamined Patent Publication No. 2012-17712, since a suction device is not required, grease loss from the bearing may be suppressed with a simple and inexpensive configuration.

A second embodiment of the present disclosure is a pump device for pumping a gas. The pump device comprises a motor portion including a rotor rotatably disposed in a rotor chamber, and a pump portion including an impeller rotatably disposed in a pump chamber and coupled to the rotor. A discharge port of the pump chamber is positioned on a lower side of the pump chamber in a vehicle mounted state. The bottom surface of the downstream end of the discharge port is positioned lower than the bottom surface of the upstream end of the discharge port.

According to the second embodiment, a liquid in the pump chamber is configured to be discharged from the discharge port by naturally flowing downwardly. Therefore, the drainage performance of the pump chamber is improved. Additionally, the likelihood of malfunction of the impeller due to freezing may be suppressed.

According embodiments of pump devices of the present disclosure, grease loss from the bearing can be suppressed with a simple and inexpensive configuration.

According to embodiments of pump devices of the present disclosure, the drainage performance of the pump chamber may be improved and a malfunction of the impeller due to freezing can be suppressed.

DETAILED DESCRIPTION

In Japanese Unexamined Patent Publication No. 2012-17712, a bearing comprising a ball bearing, which rotatably supports the rotor shaft, is provided in a partition wall separating the rotor chamber from the pump chamber. Lubricating grease is supplied into the bearing. A communication hole in the partition wall interconnects the rotor chamber and the pump chamber. A flow of gas from the pump chamber to the inside of the rotor chamber via the communication hole is generated by the operation of a suction device that reduces pressure inside of the rotor chamber. This allows for the suppression of grease loss. Inclusion of the suction device increases costs, however, if the suction device is omitted, a circulation flow passage from the pump chamber to the rotor chamber and back to the pump chamber is formed by a communication gap between the bearing members and the communication hole in the partition wall. The circulation flow passage may enhance the likelihood of grease loss when gas passes through the bearing.

In Japanese Unexamined Patent Publication No. 2012-17712, it is not assumed that the pump device is mounted on a vehicle. Therefore, when the pump device is mounted on the vehicle, liquid, such as water generated due to dew condensation or the like, may remain in the pump chamber. This may cause the impeller to malfunction, for instance due to freezing.

Hereinafter, embodiments of the present disclosure will be described with reference to the drawings.

Figure 1:
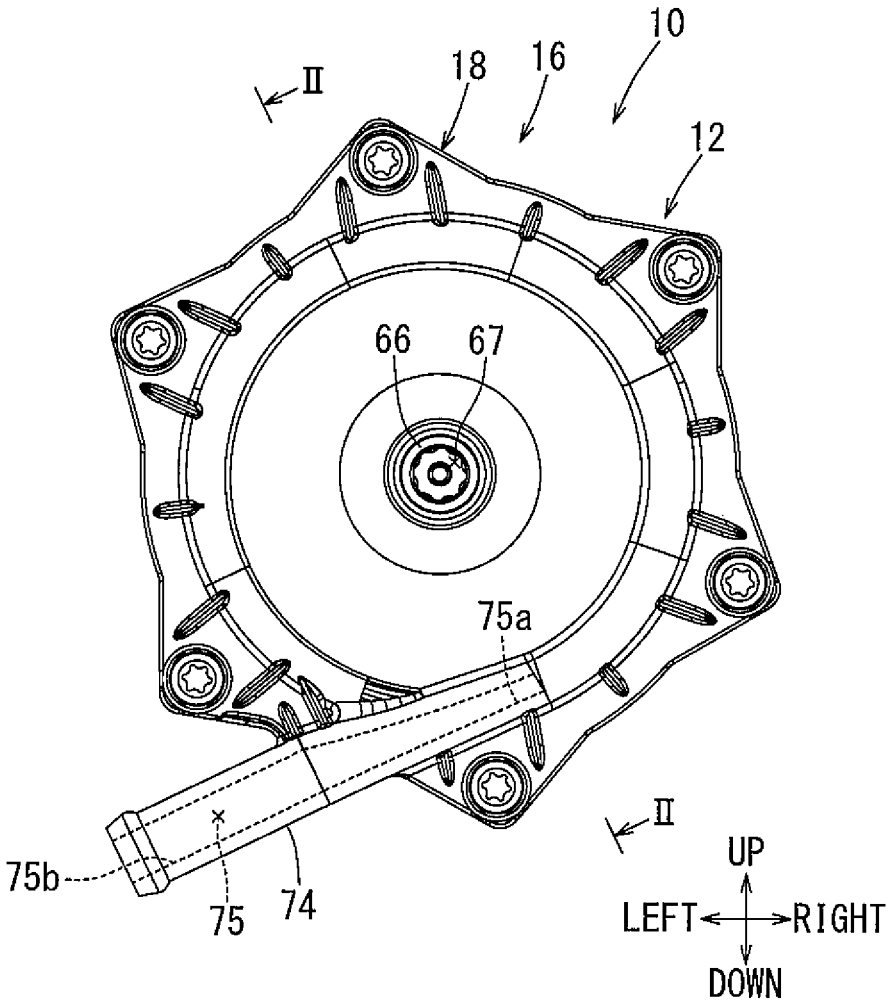
FIG. 1 is a front view of a centrifugal pump according to a first embodiment.
Figure 2:
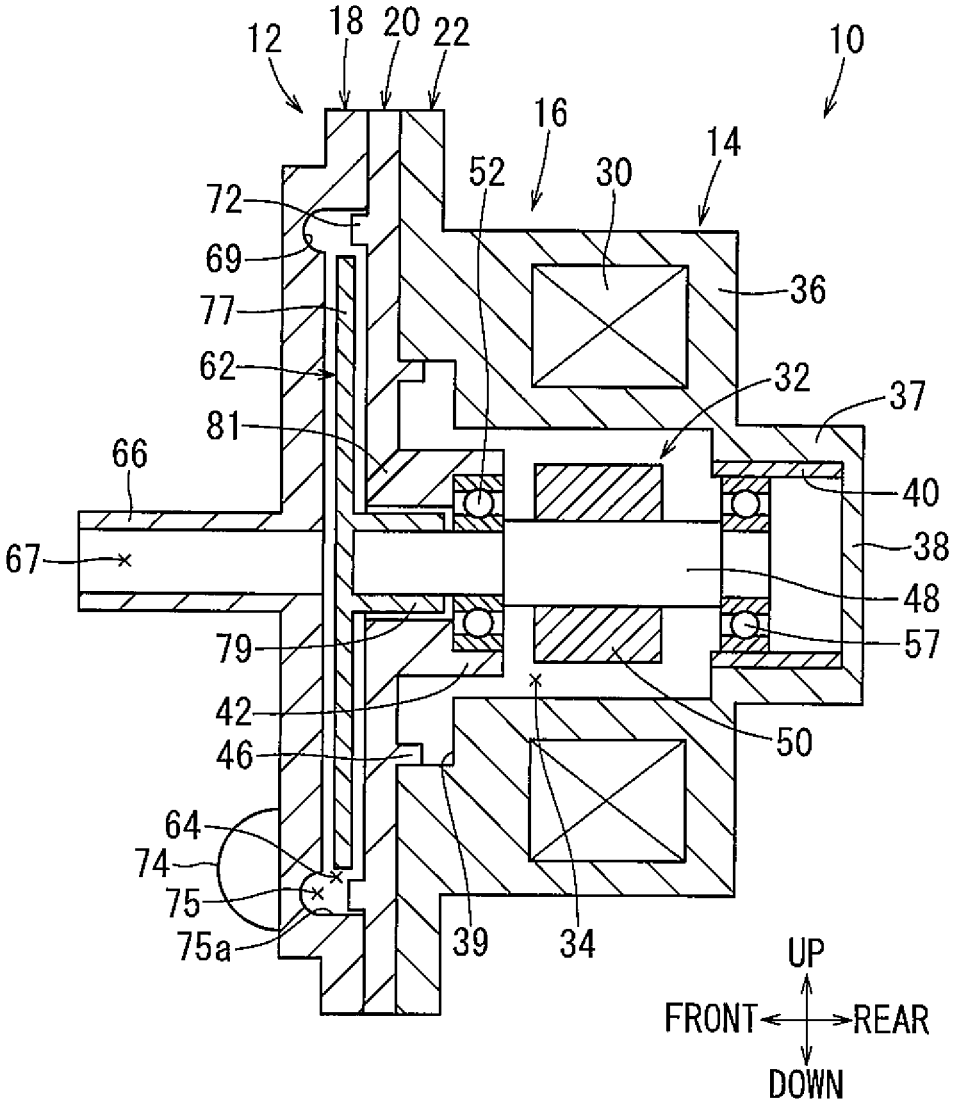
FIG. 2 is a cross-sectional view of the centrifugal pump of FIG. 1 taken along line II-II in FIG. 1, wherein the centrifugal pump includes a second casing.
Figure 3:
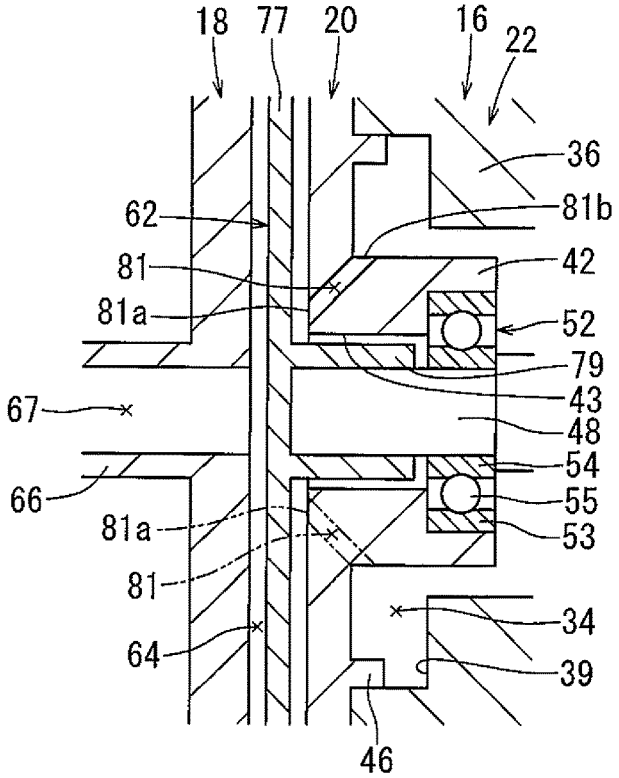
FIG. 3 is an enlarged partial view of the cross-section of the centrifugal pump in FIG. 2 showing a main part of the centrifugal pump.

In a first embodiment, for example, a centrifugal pump used as a purge pump mounted on a vehicle such as an automobile will now be described. The purge pump can increase the flow rate of a purge gas flowing from a canister to an intake passage of an internal combustion engine (an engine). FIG. 1 is a front view showing the centrifugal pump. FIG. 2 is a cross-sectional view taken along line II-II in FIG. 1. FIG. 3 is a cross-sectional view showing a main part of the centrifugal pump. The directions in the figures show the vertical direction, right-left direction, and front-rear direction of the centrifugal pump. The vertical direction corresponds to the top-and-bottom direction based on the direction of gravity when the centrifugal pump is mounted to a vehicle (i.e., in a vehicle mounted state). The left-right direction and the front-rear direction do not limit the arrangement direction of the centrifugal pump. The centrifugal pump may also be referred to as a "pump device" in the present disclosure.

As shown in FIG. 2, a centrifugal pump 10 includes a pump portion 12 and a motor portion 14 coupled end-to-end in the axial direction (the front-back direction). A casing 16 of the centrifugal pump 10 includes a first casing 18, a second casing 20, and a third casing 22, which are coupled end-to-end in the axial direction to form the casing 16.

The first casing 18 and the second casing 20 may be fastened together by, for example, a plurality of screws. The second casing 20 and the third casing 22 may be fastened together by, for example, a plurality of screws. An O-ring (not shown) for sealing between the first casing 18 and the second casing 20 may be interposed therebetween. An O-ring (not shown) for sealing between the second casing 20 and the third casing 22 may be interposed therebetween. The first to third casings 18, 20, 22 may be made of, for example, resin.

The motor portion 14 can be a brushless motor including a stator 30 and a rotor 32. A motor casing defining a rotor chamber 34 has a hollow cylindrical shape and y is formed by the second casing 20 and the third casing 22. The third casing 22 includes a cylindrical wall part 36, a cylindrical extension part 37, and a rear end wall part 38. The cylindrical wall part 36 has a cylindrical shape and extends in the front-rear direction. The cylindrical extension part 37 extends backward from an inner periphery of the rear end of the cylindrical wall part 36. The rear wall part 38 closes the rear end opening of the cylindrical extension part 37. A stepped recessed 39 is formed on the inner periphery of the front-end of the cylindrical wall part 36. A retainer 40, which has a cylindrical shape and is made of metal, is positioned inside the extension cylinder part 37.

The stator 30 is embedded in the cylindrical wall part 36 by insert molding. The stator 30 may be completely covered with the resin the forms the cylinder wall part 36. The stator 30 may be provided with, for example, a stator core and a stator coil, and may be formed in an annular shape.

The second casing 20 generally has an annular plate shape. The second casing 20 includes a boss part 42 having a hollow cylindrical shape and being concentrically formed in the center part of the rear surface of the second casing 20. As shown in FIG. 3, a shaft hole 43 extends axially through the boss part 42. The boss part 42 is fit into the front-end part of the cylindrical wall part 36 of the third casing 22 with a predetermined gap therebetween.

An annular projection 46 extends circumferentially about the boss part 42 at a predetermined radial distance therefrom and is concentrically disposed on the rear surface of the second casing 20. The annular projection 46 may have a square cross section. The annular projection 46 is into the front end opening of the stepped recessed part 39 of the third casing 22.

As shown in FIG. 2, the rotor 32 is rotatably disposed in the rotor chamber 34. The rotor 32 includes a rotor shaft 48 and permanent magnets 50. The rotor shaft 48 may be made of, for example, a metal, and may be composed of a solid shaft. The permanent magnets 50 are positioned at a center of the rotor shaft 48 in the axial direction and define a plurality of circumferentially arranged magnetic poles. A front-end part of the rotor shaft 48 is rotatably supported within the boss part 42 of the second casing 20 by a bearing 52.

As shown in FIG. 3, the bearing 52 is a ball bearing including an outer ring 53, an inner ring 54, and balls 55 positioned between rings 53, 54. In this embodiment, the inner ring 54 is press-fitted into the rotor shaft 48 from the front, and the outer ring 53 is press-fitted into the boss part 42 in the second casing 20 from the rear. A front-end part of the rotor shaft 48 defines an end part on an output side and is inserted into a center part of the boss part 42 of the second casing 20.

As shown in FIG. 2, the rear end of the rotor shaft 48 is rotatably supported within the retainer 40 of the third casing 22 by an auxiliary bearing 57. The auxiliary bearing 57 is a ball bearing and includes an outer ring, an inner ring, and balls disposed between the outer ring and the inner ring. The inner ring is fixed to the rotor shaft 48 and the outer ring is clearance-fitted in the retainer 40. A detent mechanism for stopping rotation of the outer ring may be provided between the third casing 22 and the outer ring of the auxiliary bearing 57.

A control circuit (not shown) for controlling power supply to the stator 30 may be provided on the rear side of the third casing 22. An external connector connected to an external power source may be connected to a connector part (not shown) formed in the third casing 22. The motor portion 14 may be driven by electric power supplied from an external power source.

As shown in FIG. 2, the pump portion 12 includes an impeller 62 is coupled to and rotated by the motor portion 14. The portions of the pump casing that form a pump chamber 64 include the first casing 18 and the second casing 20. The pump chamber 64 has a hollow cylindrical shape that is short in the axial direction. An intake port 66, which has a hollow cylindrical shape and projects forward, is formed in the central part of the first casing 18. An intake opening 67, which provides fluid communication between the inside and the outside of the pump chamber 64, is formed inside the intake port 66.

Figure 4:
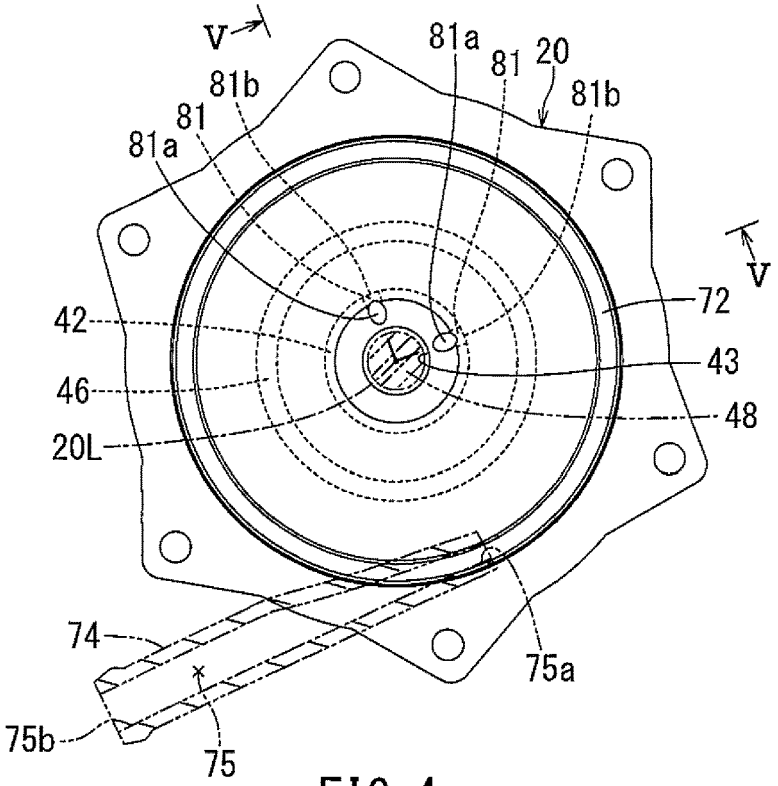
FIG. 4 is a partial cross-sectional, front view of the centrifugal pump of FIG. 1 showing the second casing.
Figure 5:
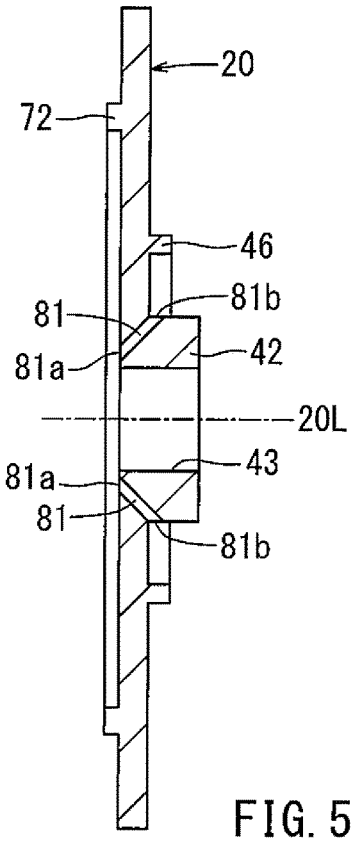
FIG. 5 is a cross-sectional view of the second casing of FIG. 4 taken along line V-V in FIG. 4.

The first casing 18 has a short cylindrical shape that opens the rear surface. An annular flow passage groove 69 is disposed along the outer periphery of the pump chamber 64 and is concentrically formed at the rear surface of the front wall of the first casing 18 (the surface on the pump chamber 64 side). The flow passage groove 69 has a substantially semicircular cross-sectional shape. FIG. 4 is a front view showing the second casing 20. FIG. 5 is a cross-sectional view taken along line V-V in FIG. 4.

As shown in FIG. 4, an annular wall 72 is concentrically formed on the front side of the second casing 20. As shown in FIG. 5, the annular wall 72 has a square crosssectional shape. As shown in FIG. 2, the outer peripheral part of the annular wall 72 is fit into the inner peripheral part of the first casing 18. The second casing 20 may also be referred to as the "partition wall" in the present disclosure.

As shown in FIG. 1, a discharge port 74 having a hollow cylindrical shape is formed at the lower end of the first casing 18. The discharge port 74 projects outward from the outer periphery of the first casing 18 in a tangential direction, that is, outward in a clockwise direction when viewed from the front. A discharge opening 75 is provided inside the discharge port 74. As shown in FIG. 2, the discharge opening 75 extends in the tangential direction of the flow passage groove 69. The upstream end of the discharge opening 75 is in fluid communication with the lower end of the pump chamber 64. A bottom surface of the upstream end 75*a* of the discharge opening 75 is connected to a lower end of an outer periphery of the pump chamber 64.

As shown in FIG. 1, the discharge opening 75 is disposed on the lower side, in the vertical direction, in the state where the centrifugal pump 10 is mounted on a vehicle. A bottom surface of the downstream end 75*b* of the discharge opening 75 is located at a position lower than the bottom surface of the upstream end 75*a* of the discharge opening 75. The bottom surface of the discharge opening 75 may be inclined obliquely downward from the bottom surface of the upstream end 75*a* toward the bottom surface of the downstream end 75*b*.

As shown in FIG. 2, the impeller 62 is rotatably housed in the pump chamber 64. The impeller 62 includes a substrate part 77, a cylindrical shaft part 79, and a plurality of blade parts (not shown). The substrate part 77 has a disc-shape. The cylindrical shaft section 79 has a hollow cylindrical shape, and is formed concentrically on the rear surface of the substrate part 77. The blade parts may be formed at predetermined circumferential intervals and may radiate from the center section of the front surface of the substrate part 77. The substrate part 77 is positioned within the annular wall 72 of the second casing 20. As shown in FIG. 3, the cylindrical shaft part 79 is rotatably disposed in the shaft hole 43 of the second casing 20.

A front end of the rotor shaft 48 is fit into the cylindrical shaft part 79 of the impeller 62. Accordingly, the impeller 62 rotates integrally with the rotor 32. A slight gap may be set between the opposed surfaces of the substrate part 77 of the impeller 62 and the second casing 20.

The motor portion 14 may be driven by electric power supplied from an external power source. Then, the impeller 62 rotates together with the rotor 32, so that the purge gas can be taken in through the intake opening 67 and sent to the pump chamber 64. The purge gas may be pressurized by the rotation of the impeller 62, and then discharged from the discharge opening 75. In this way, purge gas may be pumped by the centrifugal pump 10.

As shown in FIGS. 3 to 5, two linear communication holes 81 provide fluid communication between the rotor chamber 34 and the pump chamber 64 formed in the second casing 20. Each communication hole 81 has a front end opening 81*a*, which opens in the vicinity of the shaft hole 43 on the front surface of the second casing 20 on the pump chamber 64 side, and a rear end opening 81*b* opposite to the front end opening 81*a*.

As shown in FIG. 4, the front end opening 81*a* and the rear end opening 81*b* of each communication hole 81 are arranged so as to be aligned along the radial direction of the second casing 20. The two communication holes 81 may be arranged at a position higher than the rotor shaft 48 (e.g., in the vertical direction). That is, the front end opening 81*a* of both communication holes 81 may be arranged at a position higher than a center axis of the rotor shaft 48 (e.g., in the vertical direction). Both communication holes 81 may be angularly spaced apart from each other by about 90° about the axis 20L of the second casing 20. Thus, the front end opening 81*a* of both communication holes 81 may be arranged at a position adjacent to each other. The communication hole 81 may also be referred to as a "breathing passage" in the present disclosure. In addition, the phrase "positioned adjacent to each other" in the present disclosure refers to, for example, a position where the shortest distance between the front-end openings 81*a* of the adjacent communication holes 81 is equal to or less than the diameter of the shaft hole 43.

According to the first embodiment, the circulation flow passage, which flows from the pump chamber 64 to the rotor chamber 34 and back to the pump chamber 64, is formed by both communication holes 81 in the second casing 20 partitioning the rotor chamber 34 and the pump chamber 64. That is, one of the communication holes 81 may serve as a flow passage from the pump chamber 64 to the rotor chamber 34, and the other communication hole 81 may serve as a flow passage from the rotor chamber 34 to the pump chamber 64. Therefore, since the gas flows preferentially through the circulation flow passage that bypasses the bearing 52, grease loss from the bearing 52 may be suppressed. Also, unlike the pump device according to Japanese Unexamined Patent Publication No. 2012-17712, since the suction device is not required, grease loss from the bearing 52 may be suppressed with a relatively simple and inexpensive configuration.

The front-end openings 81*a* of both communication holes 81 are arranged at positions adjacent to each other. Therefore, the pressure difference between both communication holes 81 may be reduced, thereby offering the potential to further suppress the grease loss from the bearing 52.

The discharge opening 75 of the pump chamber 64 is disposed on the lower side (in the vertical direction) of the pump chamber 64 in the vehicle mounted state. The bottom surface of the downstream end 75*b* of the discharge opening 75 is disposed at a position lower than the bottom surface of the upstream end 75*a* of the discharge opening 75. Therefore, the liquid in the pump chamber 64 may be discharged from the discharge opening 75 by naturally flowing downward. As a result, the liquid discharge property of the pump chamber 64 may be improved, thereby suppressing the malfunction of the impeller 62 due to freezing.

The front end openings 81*a* of both communication holes 81 are disposed at a position higher than the rotor shaft 48. Therefore, liquid such as water generated by dew condensation or the like in the pump chamber 64 may be prevented from entering the rotor chamber 34 via the communication hole 81. As a result, deterioration of the durability of the motor portion 14 may be improved.

Figure 6:
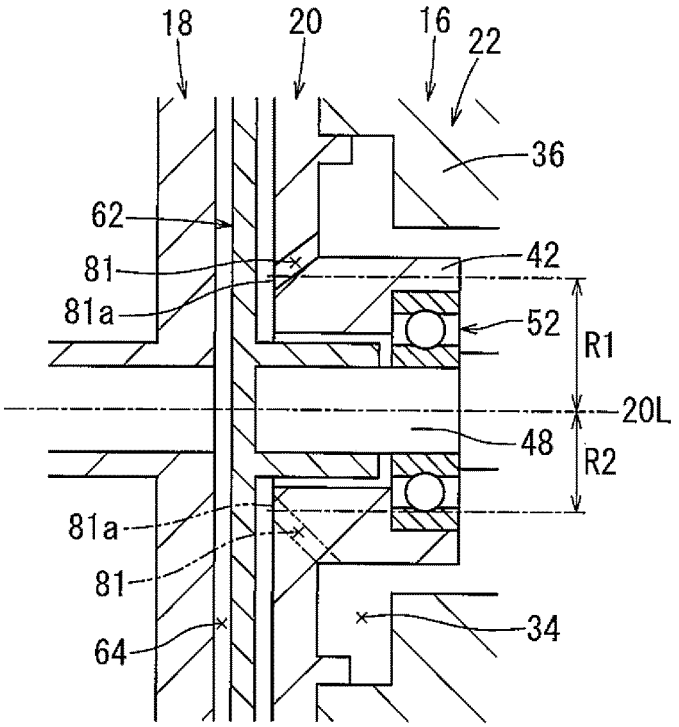
FIG. 6 is an enlarged, partial cross-sectional view showing a main part of a centrifugal pump according to a second embodiment.

Since a second embodiment is a modification of the first embodiment, the modified parts will be described, and the substantially duplicate description will be omitted. FIG. 6 is a cross-sectional view showing a main part of a centrifugal pump according to the second embodiment. As shown in FIG. 6, in the second embodiment, the distance R1 from the central axis 20L of the second casing 20 to the center of the front end opening 81*a* of the communication hole 81 on one side (upper side in FIG. 6) of the axis 20L and the distance R2 from the central axis 20L of the second casing 20 to the center of the front end opening 81*a* of the other communication hole 81 may be set as different distances. That is, the distances R1 and R2 may be set to R1 is greater than R2.

Figure 7:
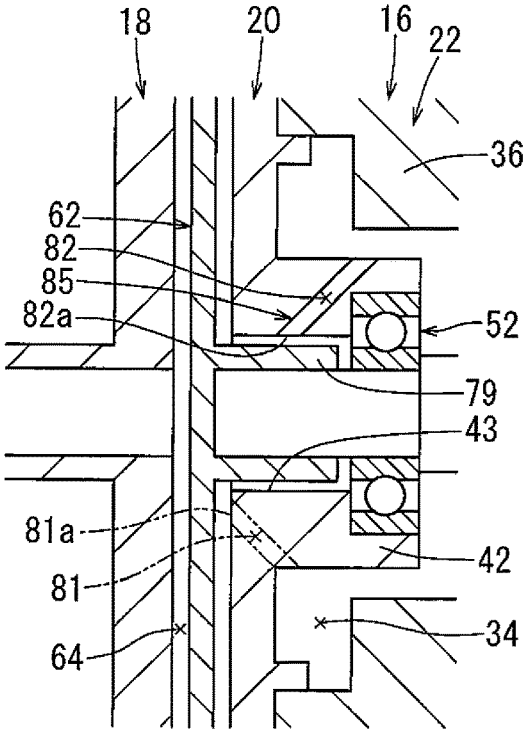
FIG. 7 is an enlarged, partial cross-sectional view showing a main part of a centrifugal pump according to a third embodiment.

Since a third embodiment is a modification of the first embodiment, the modified parts will be described, and the substantially duplicate description will be omitted. FIG. 7 is a cross-sectional view showing a main part of a centrifugal pump according to the third embodiment. As shown in FIG. 7, in the third embodiment, a front end opening 82*a* of a communication hole 82 on one side (upper side in FIG. 7) is opened to the shaft hole 43 of the second casing 20. The front end opening 82*a* is positioned on the shaft hole 43 located at the front side of the bearing 52 (the pump chamber 64 side). According to the third embodiment, a breathing passage 85 is formed by: the communication hole 82 on one side, and a gap between the shaft hole 43 in the second casing 20 and the cylindrical shaft part 79 of the impeller 62.

According to the third embodiment, the breathing passage 85 communicates with a portion of the pump chamber 64 on the lowest pressure side of the pump chamber 64. Further, the front end opening 81*a* of the communication hole 81 is also opened to the shaft hole 43 of the second casing 20 at the front side of the bearing 52.

Figure 8:
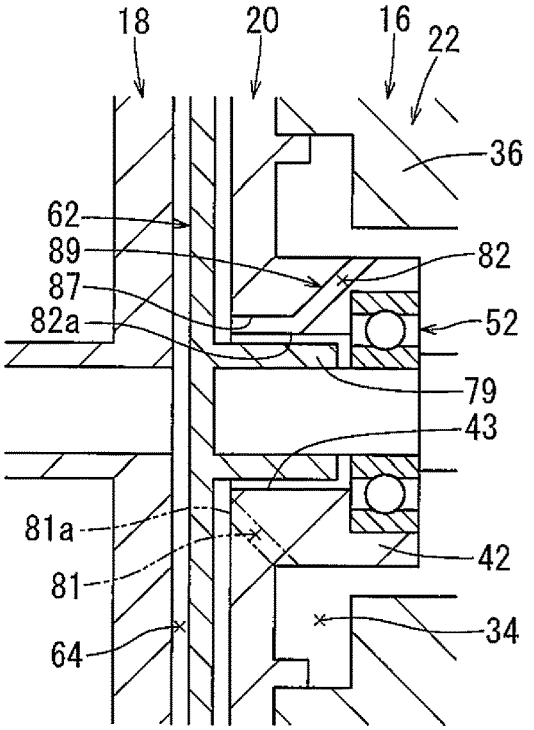
FIG. 8 is an enlarged, partial cross-sectional view showing a main part of a centrifugal pump according to a fourth embodiment.

Since a fourth embodiment is a modification of the third embodiment, the modified parts will be described, and the substantially duplicate description will be omitted. FIG. 8 is a cross-sectional view showing a main part of a centrifugal pump according to the fourth embodiment. As shown in FIG. 8, in the fourth embodiment, a communication groove 87 extends linearly from the front end opening 82*a* of the communication hole 82 toward the pump chamber 64 and is formed on the inner periphery of the shaft hole 43 of the second casing 20. According to the fourth embodiment, a breathing passage 89 is formed by: the communication hole 82 on one side, a gap between the shaft hole 43 of the second casing 20 and the cylindrical shaft part 79 of the impeller 62, and the communication groove 87.

When the opening areas of the communication hole 81 and the communication groove 87 are set to be the same or substantially the same, the system is effective at suppressing grease loss from the bearing 52. In another embodiment, the communication hole 81 may have the same configuration as the breathing passage 89.

Figure 9:
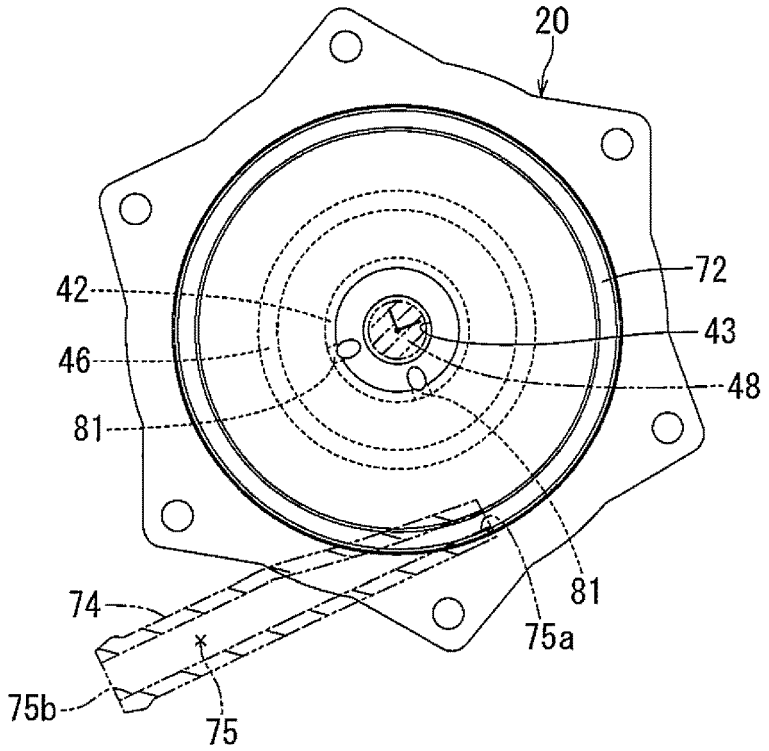
FIG. 9 is a partial, cross-sectional front view of a second casing according to a fifth embodiment.

Since a fifth embodiment is a modification of the first embodiment, the modified parts will be described, and the substantially duplicate description will be omitted. FIG. 9 is a front view showing a second casing according to the fifth embodiment. As shown in FIG. 9, in the fifth embodiment, both communication holes 81 are located at a position lower than the rotor shaft 48. According to the fifth embodiment, any liquid that is about to accumulate in either of communication holes 81 may be discharged by naturally flowing down.

Figure 10:
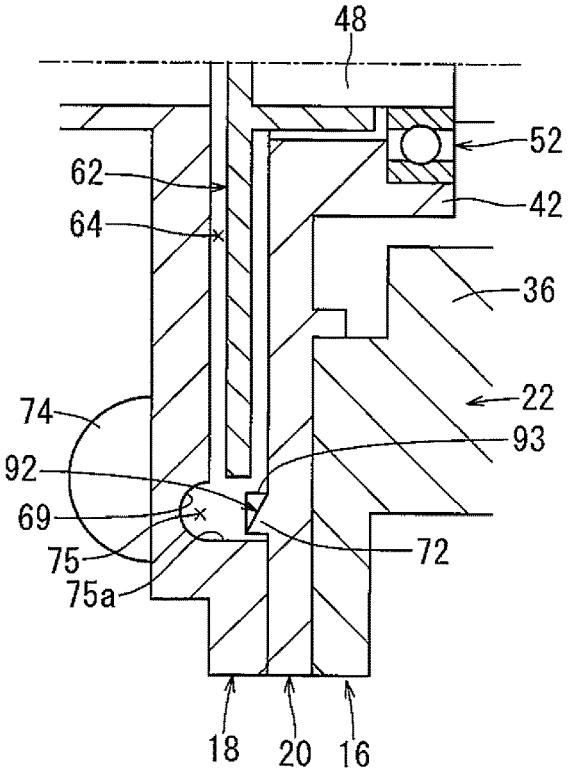
FIG. 10 is a cross-sectional view of a main part of a centrifugal pump according to a sixth embodiment.

Since a sixth embodiment is a modification of the first embodiment, the modified parts will be described, and the substantially duplicate description will be omitted. FIG. 10 is a cross-sectional view showing a main part of a centrifugal pump according to the sixth embodiment. As shown in FIG. 10, a guide recess 92 is formed at the lower end of the annular wall 72 of the second casing 20. The guide recess 92 has a guide surface 93, which is inclined obliquely downward from the rear side to the front side. A passage area at the rear surface of the impeller 62 at the lower end of the pump chamber 64 is enlarged by the guide recess 92. The guide surface 93 of the guide recess 92 may guide the liquid at the rear surface of the impeller 62 toward the discharge opening 75.

According to the sixth embodiment, the surface tension of the liquid accumulated on the rear surface side of the impeller 62 at the lower end of the pump chamber 64 may be reduced due to the guide recess 92. Accordingly, the liquid may quickly and naturally flow down toward the discharge opening 75. As a result, the drainage performance of the pump chamber 64 may be further improved.

Figure 11:
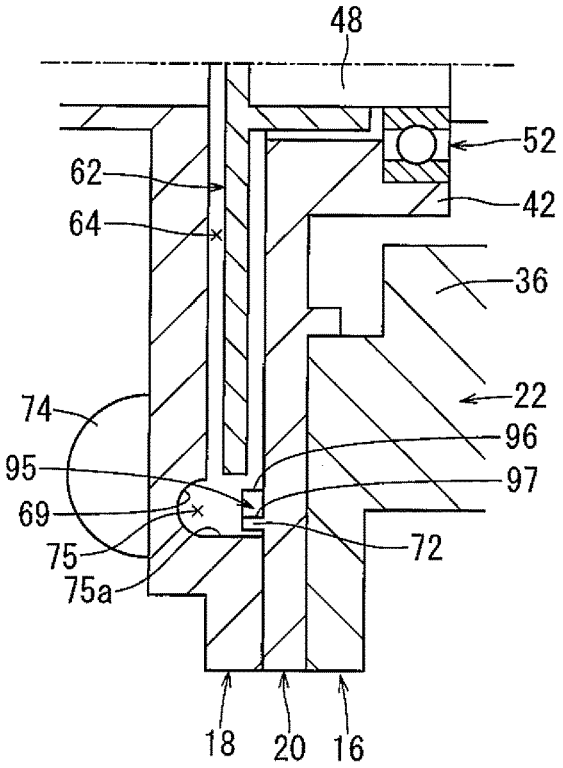
FIG. 11 is a cross-sectional view of a main part of a centrifugal pump according to a seventh embodiment.

Since a seventh embodiment is a modification of the first embodiment, the modified parts will be described, and the substantially duplicate description will be omitted. FIG. 11 is a cross-sectional view showing a main part of a centrifugal pump according to the seventh embodiment. As shown in FIG. 11, a guide recess 95 is formed on the inner periphery of the lower end of the annular wall 72 of the second casing 20. A rear surface 96 of the guide recess 95 is formed along the same plane as the front surface of the second casing 20. The passage area at the rear side of the impeller 62 at the lower end of the pump chamber 64 is enlarged by the guide recess 95. A lower surface 97 of the guide recess 95 is horizontally oriented. The lower surface 97 of the guide recess 95 may guide the liquid at the rear surface of the impeller 62 toward the discharge opening 75.

According to the seventh embodiment, the surface tension of the liquid accumulated at the rear surface of the impeller 62 at the lower end of the pump chamber 64 may be reduced due to the guide recess 95. Accordingly, the liquid may quickly and naturally flow down toward the discharge opening 75. As a result, the drainage performance of the pump chamber 64 may be further improved.

Figure 12:
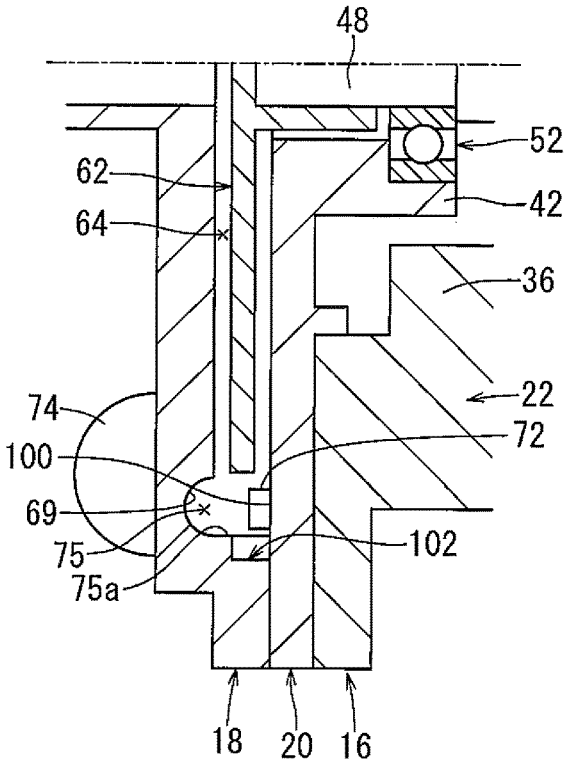
FIG. 12 is a cross-sectional view of a main part of a centrifugal pump according to an eighth embodiment.

Since an eighth embodiment is a modification of the first embodiment, the modified parts will be described, and the substantially duplicate description will be omitted. FIG. 12 is a cross-sectional view showing a main part of a centrifugal pump according to the eighth embodiment. As shown in FIG. 12, a guide groove 100 extends through the annular wall 72 of the second casing 20 in the vertical direction at the lower end of the annular wall 72. The passage area at the rear surface of the impeller 62 at the lower end of the pump chamber 64 is enlarged by the guide groove 100. A liquid reservoir 102, which has a recessed shape, is formed at the lower end of the outer peripheral surface of the pump chamber 64 of the first casing 18. The liquid reservoir 102 is positioned at a lower end of the pump chamber 64. The liquid reservoir 102 has a bottom lower than the bottom surface of the upstream end 75*a* of the discharge opening 75.

According to the eighth embodiment, the surface tension of the liquid accumulated at the rear surface of the impeller 62 at the lower end of the pump chamber 64 may be reduced due to the guide groove 100. Accordingly, the liquid may quickly and naturally flow down. Further, the liquid flowing down from the rear surface of the impeller 62 at the lower end of the pump chamber may be discharged to the discharge opening 75 or may accumulate in the liquid reservoir 102.

Figure 13:
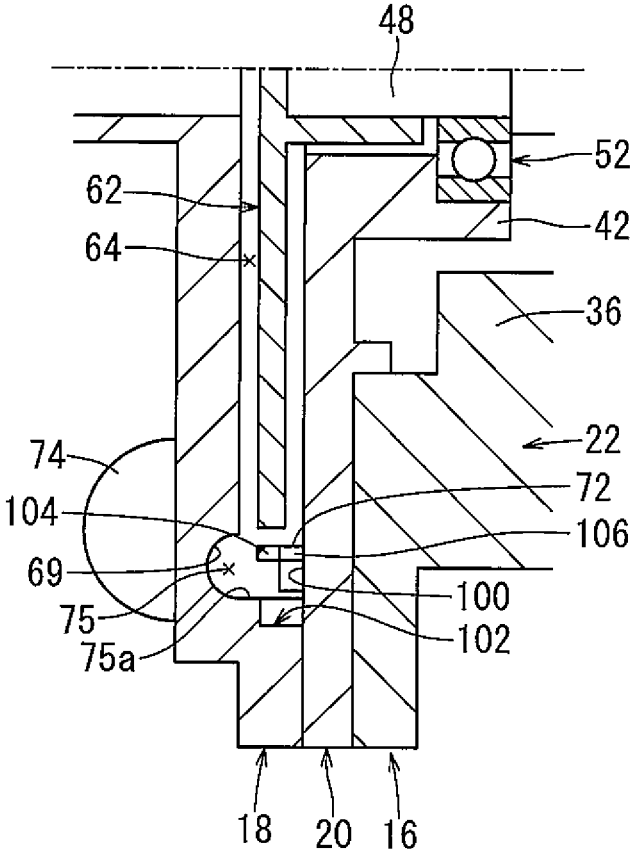
FIG. 13 is a cross-sectional view of a main part of a centrifugal pump according to a ninth embodiment.

Since a ninth embodiment is a modification of the first embodiment, the modified parts will be described, and the substantially duplicate description will be omitted. FIG. 13 is a cross-sectional view showing a main part of a centrifugal pump according to the ninth embodiment. As shown in FIG. 13, in the ninth embodiment, a horizontal member 104, which lays horizontally in the circumferential direction, is formed at the front upper corner of the guide groove 100. A partition 106 is provided between the horizontal member 104 and the second casing 20, so as to partition the space between the horizontal member 104 and the second casing 20 into a plurality of spaces in the circumferential direction.

According to the ninth embodiment, the guide groove 100 is provided with the horizontal member 104 and the partition 106. Accordingly, a pressure drop from the pump chamber 64 to the liquid reservoir 102 may be suppressed. In other embodiments, the partitions 106 may be omitted.

The present disclosure is not limited to the above-described embodiments, and various modifications are possible within the scope of the present disclosure. For example, the pump device of the present disclosure may be applied to a pump device used for pumping a gas other than a purge gas such as air. The present disclosure may also be applied to a pump device other than a centrifugal pump. Further, the brushless motor of the motor portion 14 may be replaced with a bushed motor. The number of breathing passages may be increased to three or more. The shape and/or arrangement of the breathing passages may be modified as appropriate.

In the present disclosure, various aspects and embodiments are disclosed. A first aspect is a pump device for pumping a gas. The pump device comprises a motor portion in which a rotor is provided in a rotor chamber in a rotatable manner, and a pump portion in which an impeller coupled to the rotor is provided in a pump chamber in a rotatable manner. A bearing, which rotatably supports a rotor shaft of the rotor and is injected with a grease, is provided in a partition wall separating the rotor chamber from the pump chamber. At least two breathing passages that interconnect the rotor chamber and the pump chamber are formed in the partition wall.

According to the first aspect, a circulation flow passage, which flows from the pump chamber to the rotor chamber and back to the pump chamber, is formed by the at least two breathing passages provided in the partition wall separating the rotor chamber from the pump chamber. Therefore, since a gas preferentially flows through the circulation flow passage that bypasses the bearing, grease loss from the bearing may be suppressed. Also, unlike the pump device according to Patent Document 1, since a suction device is not required, grease loss from the bearing may be suppressed with a simple and inexpensive configuration.

A second aspect is a pump device according to the first aspect, wherein openings at the pump chamber side of the at least two breathing passages may be arranged adjacent to each other.

According to the second aspect, a pressure difference between the at least two breathing passages may be reduced, thereby further suppressing the loss of grease from the bearing.

A third aspect is a pump device according to the first or second aspect, wherein the opening on the pump chamber side of at least one of the breathing passages may be open to a shaft hole. The rotor shaft penetrates the shaft hole and the shaft hole is positioned at the pump chamber side of the bearing.

According to the third aspect, at least one breathing passage may communicate with a position on a lowest pressure side of the pump chamber.

A fourth aspect is a pump device according to any one of the first to third aspects, wherein a discharge opening of the pump chamber may be arranged on a lower side of the pump chamber in a vertical direction of the pump chamber, the vertical direction corresponding to the pump device in a vehicle mounted state. The bottom surface of the downstream end of the discharge opening may be arranged at a position lower than the bottom surface of the upstream end of the discharge opening.

According to the fourth aspect, liquid in the pump chamber may be discharged from the discharge opening by naturally flowing down. As a result, the drainage property of the pump chamber may be improved, and the malfunction of the impeller due to freezing may be suppressed.

A fifth aspect is a pump device according to the fourth aspect, wherein the opening on the pump chamber side of the at least two breathing passages may be located at a position higher than the rotor shaft.

According to the fifth aspect, liquid in the pump chamber may be prevented from entering the rotor chamber via the breathing passages. Therefore, a decrease in durability of the motor portion may be improved.

A sixth aspect is a pump device for pumping gas, which may include a motor portion in which a rotor is provided in a rotor chamber in a rotatable manner, and a pump portion in which an impeller coupled to the rotor is provided in a pump chamber in a rotatable manner. A discharge port of the pump chamber is arranged on a lower side of the pump chamber in a vertical direction of the pump chamber, the vertical direction corresponding to the pump device being in a vehicle mounted state. The bottom surface of a downstream end of the discharge port is arranged at a position lower than the bottom surface of an upstream end of the discharge port.

According to the sixth aspect, a liquid in the pump chamber may be capable of being discharged from the discharge port by naturally flowing down. Therefore, drainage performance of the pump chamber can be improved, and malfunction of the impeller due to freezing may be suppressed.

A seventh aspect is a pump device according to the sixth aspect, wherein a guide recess, which guides a liquid at the rear surface of the impeller toward the discharge opening while enlarging a passage area at the rear surface of the impeller, may be formed at the lower end of the pump chamber.

According to the seventh aspect, the surface tension of the liquid accumulated at the rear surface side of the impeller at the lower end of the pump chamber may be reduced due to the guide recess. Accordingly, the liquid may quickly and naturally flow down toward the discharge port. As a result, the drainage performance of the pump chamber may be further improved.

An eighth aspect is a pump device according to the sixth aspect, wherein a liquid reservoir, which has a bottom lower than a bottom surface on the intake opening side of the discharge opening, may be formed at the lower end of the pump chamber.

According to the eighth aspect, the liquid flowing down at the rear surface side of the impeller at the lower end of the pump chamber may be discharged toward the discharge opening and/or may accumulate in the liquid reservoir.

While the embodiments of the disclosure have been described with reference to specific configurations, it will be apparent to those skilled in the art that many alternatives, modifications, and variations may be made without departing from the scope of the present disclosure. Accordingly, embodiments of the present disclosure are intended to embrace all such alternatives, modifications, and variations that may fall within the spirit and scope of the appended claims. Embodiments of the present disclosure should not be limited to the representative configurations, but may be modified, for example, as described below.

The various examples described above in detail with reference to the attached drawings are intended to be representative of the present disclosure, and are thus non-limiting embodiments. The detailed description is intended to teach a person of skill in the art to make, use, and/or practice various aspects of the present teachings, and thus does not limit the scope of the disclosure in any manner. Furthermore, each of the additional features and teachings disclosed above may be applied and/or used separately or with other features and teachings in any combination thereof, to provide an improved pump device, and/or methods of making and using the same.

The invention claimed is:

1. A pump device for pumping a gas, comprising:

a motor portion including a rotor chamber and a rotor rotatably disposed in the rotor chamber, wherein the rotor includes a rotor shaft;

a pump portion including a pump chamber and an impeller rotatably disposed in the pump chamber, wherein the impeller is coupled to the rotor shaft and is configured to rotate with the rotor shaft;

a partition wall separating the rotor chamber from the pump chamber, wherein the partition wall has a first side that faces the pump chamber and a second side that faces the rotor chamber;

a shaft hole extending through the partition wall along a central axis, wherein the rotor shaft extends through the shaft hole; and a bearing provided in the shaft hole, wherein the bearing rotatably supports the rotor shaft and is configured to be injected with grease, wherein the partition wall includes a first breathing passage and a second breathing passage that each extend linearly through the partition wall separately from the shaft hole and that each provide fluid communication between the rotor chamber and the pump chamber, wherein the first breathing passage has a first opening on positioned on the first side of the partition wall and a second opening on the second side of the partition wall, wherein the first opening is radially closer to the shaft opening than the second opening with respect to the central axis, and wherein the second breathing passage has a third opening positioned on the first side of the partition wall and a fourth opening on the second side of the partition wall, wherein the third opening is radially closer to the shaft opening than the fourth opening with respect to the central axis.

2. The pump device of claim 1, wherein the first opening of the first breathing passage is positioned adjacent to the third opening of the second breathing passage about the shaft hole.

3. The pump device of claim 1, wherein:

a discharge opening of the pump chamber is positioned on a lower side of the pump chamber in a vertical direction of the pump chamber when the pump device is in a vehicle mounted state, and a bottom surface of a downstream end of the discharge opening is positioned lower than a bottom surface of an upstream end of the discharge opening.

4. The pump device of claim 3, wherein the first opening of the first breathing passage and the third opening of the second breathing passage are positioned above the rotor shaft along the vertical direction.

5. The pump device of claim 3, wherein a guide recess is formed at the lower side of the pump chamber, wherein the guide recess is configured to guide a liquid on a rear surface of the impeller toward the discharge opening.

6. The pump device of claim 3, wherein a liquid reservoir is formed at the lower side of the pump chamber, wherein the liquid reservoir has a bottom lower than a bottom surface of an upstream end of the discharge opening.

7. The pump device of claim 1, wherein a distance between the first opening of the first breathing passage and the central axis is greater than a distance between the third opening of the second breathing passage and the central axis.

8. The pump device of claim 1, wherein the first breathing passage is configured to be in fluid communication with the second breathing passage when the rotor shaft is rotating.

9. The pump device of claim 1, wherein the first breathing passage and the second breathing passage are configured to circulate a circulation flow from the pump chamber to the rotor chamber via the first breathing passage, and then from the rotor chamber to the pump chamber via the second breathing passage.

* * * * *